US009359842B2

(12) United States Patent
Smith et al.

(10) Patent No.: US 9,359,842 B2
(45) **Date of Patent: *Jun. 7, 2016**

(54) DOWNHOLE ACTUATING APPARATUS

(71) Applicant: Petrowell Limited, Dyce, Aberdeen (GB)

(72) Inventors: Colin Smith, Aberdeen (GB); Daniel George Purkis, Aberdeen (GB)

(73) Assignee: PETROWELL LIMITED, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/255,249

(22) Filed: Apr. 17, 2014

(65) Prior Publication Data

US 2014/0224475 A1 Aug. 14, 2014

Related U.S. Application Data

(63) Continuation of application No. 13/627,705, filed on Sep. 26, 2012, now Pat. No. 8,701,776, which is a continuation of application No. PCT/GB2011/050467, filed on Mar. 10, 2011.

(30) Foreign Application Priority Data

Mar. 26, 2010 (GB) ..... 1005133.2

(51) Int. Cl.

| | |
|---|---|
| ***E21B 23/04*** | (2006.01) |
| ***E21B 23/00*** | (2006.01) |
| ***E21B 21/10*** | (2006.01) |
| ***E21B 34/14*** | (2006.01) |

(52) U.S. Cl.

CPC ..... *E21B 23/004* (2013.01); *E21B 21/103* (2013.01); *E21B 23/006* (2013.01); *E21B 23/04* (2013.01); *E21B 34/14* (2013.01)

(58) Field of Classification Search

CPC ..... E21B 23/004; E21B 23/006

See application file for complete search history.

(56) References Cited

U.S. PATENT DOCUMENTS

| | | | | |
|---|---|---|---|---|
| 6,173,795 | B1 * | 1/2001 | McGarian et al. | 175/231 |
| 8,701,776 | B2 * | 4/2014 | Smith et al. | 166/318 |
| 2011/0203800 | A1 * | 8/2011 | Tinker et al. | 166/318 |
| 2011/0278017 | A1 * | 11/2011 | Themig et al. | 166/373 |
| 2013/0186644 | A1 * | 7/2013 | Smith et al. | 166/381 |

* cited by examiner

*Primary Examiner* — Giovanna C Wright

(74) *Attorney, Agent, or Firm* — Blank Rome LLP

(57) ABSTRACT

A downhole tool comprises a housing defining a main bore and an actuatable member moveable from a first configuration to a second configuration to permit actuation of the tool. The tool includes an indexer mounted within the housing and arranged to progress linearly in a first direction along the main bore of the housing in a predetermined number of discrete sequential and progressive steps of linear movement in said first direction by passage of a corresponding number of objects through the indexer to cause said actuatable member to move towards its second configuration.

28 Claims, 7 Drawing Sheets

DOWNHOLE ACTUATING APPARATUS

FIELD OF INVENTION

The present invention relates to mechanical devices for counting input signals. In particular, the invention relates to mechanical devices for counting input signals to actuate downhole tools in a sequential manner.

BACKGROUND TO INVENTION

There are many situations in which downhole tools must be selectively actuated. However, communicating with the tools to cause actuation can be difficult in the downhole environment. Systems such as RFID systems exist but these are complex, expensive and prone to failure. Indeed, any form of electrical, electronic or magnetic device is often not robust enough to withstand the harsh downhole environment.

During hydraulic fracturing of a multiple zone well, a series of tools, or clusters of tools, are provided at each zone, and each downhole tool needs to be actuated and fluid is diverted to flow outwards to fracture the well. The actuation must be performed in a sequential manner to allow the borehole to be progressively fractured along the length of the bore, without leaking fracture fluid out through previously fractured regions.

Due to the expense and frequent failure of electronic or electrical devices, the most common approach to tool actuation is still fully mechanical. Balls of ever increasing size are dropped down a tubular positioned within the well bore. The tools are configured so that the first dropped ball, which has the smallest diameter, passes though the first and intermediate tools, which have a ball seat (hereinafter referred to as a valve seat) larger than the ball, until it reaches the furthest away tool in the well. This furthest away tool is configured to have a valve seat smaller than the first dropped ball so that the ball seats at the tool to block the main passage and cause transverse ports to open thus diverting the fluid flow. Subsequently dropped balls are of increasing size so that they too pass through the nearest tools but seat at further away tools which have a suitably sized valve seat. This is continued until all the tools have been actuated in the order of furthest away to nearest.

Therefore, this approach does not involve counting the dropped balls. Balls which are too small for a particular tool are simply not registered. However, this approach has a number of disadvantages. The number of tools with varying valve seats that can be used is limited in practice because there must be a significant difference in the size of the seat (and therefore the ball) so that the ball does not inadvertently actuate previous tools. Also, the valve seats act as restrictions to flow through the tubular which are always undesirable. The smaller the seat the greater the restriction.

It is desirable to provide an apparatus which allows: actuation of a large number of downhole tools; and/or downhole tools with the same size of valve seat; and/or valve seats with the largest possible diameter.

SUMMARY OF INVENTION

According to a first aspect of the present invention there is provided a mechanical counting device locatable at each of a plurality of downhole tools arranged within and along a well bore, each tool having a main bore corresponding to the tubular positioned in the well bore, and each tool being actuatable to open one or more fluid ports which are transverse to the main bore, the mechanical counting device comprising:

linear indexing means adapted to cause the mechanical counting device to linearly progress along the main bore by a predetermined distance in response to receiving an actuating signal until reaching an actuation site of the tool whereupon the tool is actuated, wherein the mechanical counting device is locatable at a plurality of different predetermined positions within the main bore such that the downhole tools are sequentially actuatable.

The mechanical counting device may be adapted to engage with one of a plurality of longitudinal recesses provided along the main bore.

The mechanical counting device may be adapted to linearly progress along the main bore by the predetermined distance in response to an object, such as a ball, dropped within the tubular positioned within the well bore, which thus provides the actuating signal.

The mechanical counting device may be adapted, upon reaching the actuation site, to cause the dropped object to stop at the tool, thus blocking the main bore at the tool.

The mechanical counting device may be adapted to linearly progress in a number of discrete steps to the actuation site. Each discrete step may correspond to the mechanical counting device moving from one longitudinal recess to the adjacent longitudinal recess.

The mechanical counting device may comprise a collet member having a number of fingers and a protrusion provided at the end of each finger. Each finger may be flexible. The collet member may comprise a tubular member having a bore which is sized such that the dropped object may pass through the tubular member. Each finger may be movable between a first position in which the protrusion is out with the bore of the tubular member and a second position in which the protrusion is within the bore of the tubular member and contactable by the dropped object. Each finger may be bendable between the first and second positions.

The collet member may be locatable within the main bore such that the protrusion of one or more fingers is engaged with a recess when the finger is at the first position and not engaged with a recess when the finger is at the second position.

The collet member may comprise a first set of fingers and a second set of fingers which is longitudinally spaced from the first set. The collet member and the recesses may be configured such that, when the fingers of the first set are engaged with a recess, the fingers of the second set are not engaged with a recess. The collet member and the recesses may be configured such that, when the fingers of the second set are engaged with a recess, the fingers of the first set are not engaged with a recess.

The collet member may be adapted such that the dropped object passing through the main bore contacts the protrusion of the one or more fingers which are at the second position such that the collet member is linearly moved in the direction of travel of the dropped object. The collet member may be linearly moved until the protrusion engages with the next recess. The collet member may be adapted such that engagement with the next recess allows the dropped object to continue past the set of fingers of which the protrusion has engaged with the next recess.

The collet member may be adapted such that the linear movement causes the protrusion of the one or more fingers which are at the first position to disengage from the recess and move to the second position. The collet member may be linearly moved by the impact force from the dropped object and/or by fluid pressure upstream of, and acting on, the dropped object.

In this manner, the collet member is linearly movable in a stepwise sequence, moving one recess every time an object is dropped.

The mechanical counting device may be movable towards a sleeve member provided within the main bore and adapted to block the transverse ports. The collet member may be adapted to contact and act upon the sleeve member upon reaching the actuation site to move the sleeve member and cause fluid communication between the main bore and the transverse ports.

In this manner, the collet member is linearly movable one recess at a time towards the actuation site whereupon it causes moving of the sleeve member to open the transverse ports. The main bore of each tool can be provided with a large number of recesses. For a particular tool, the collet member can be located a particular number of recesses from the actuation site. The number of recesses can be arranged to vary for each tool depending on its proximity to the surface. For instance, the tool furthest from the surface could have the least number of recesses, such as only one, while the tool nearest the surface could have the greatest number of recesses, such as fifty if there is a total of fifty tools within the well bore. The tools will therefore sequentially actuate in the order of furthest away to nearest.

BRIEF DESCRIPTION OF DRAWINGS

Embodiments of the present invention will now be described, by way of example only, with reference to the accompanying drawings in which.

DETAILED DESCRIPTION OF DRAWINGS

Figure 1:
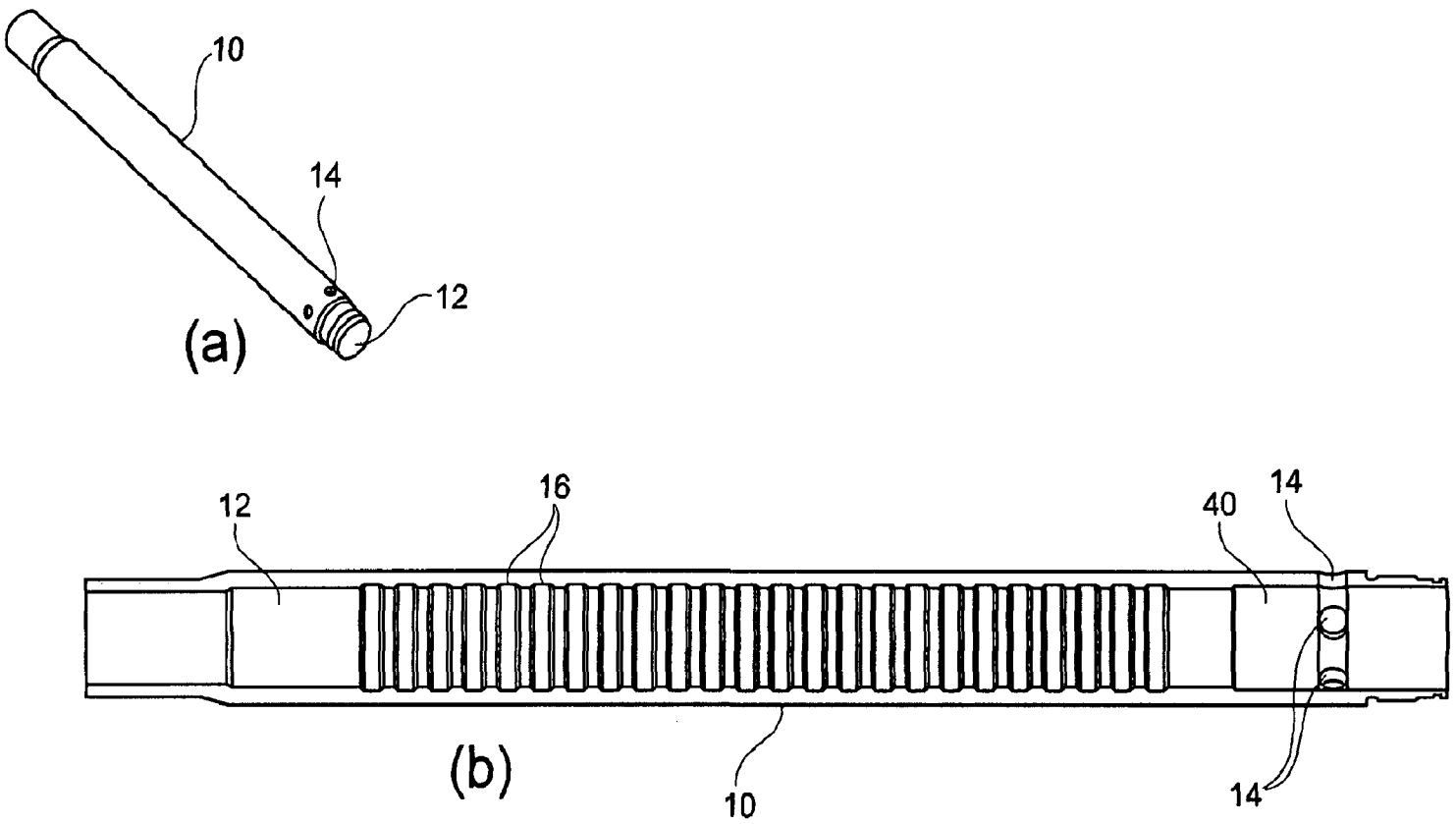
FIG. 1 is a (a) perspective view and a (b) sectional side view of a housing of a tool (shown in FIG. 3) of a downhole actuating apparatus.

FIG. 1 shows a downhole tool 10 of a downhole actuating apparatus. The apparatus comprises many of these downhole tools 10, such as fifty, which can be secured to a tubular and sequentially arranged along a well bore. As utilized throughout this specification, the term "tubular" refers to any generally tubular conduit for transporting fluid, particularly oil, gas and/or water, in and/or from a subterranean well. A "tubular" as deployed in a subterranean well, may be formed from individual, discrete lengths of generally tubular conduit usually secured together by means of collars to form, for example a tubing string, drill string, casing string, liner, etc., which is positioned in a subterranean well and utilized, at least in part, to transport fluids. The tubular may have a bore of a generally uniform diameter throughout the length thereof or may have two or more sections having bores of different diameters. For example, the tubular may be comprised of a casing string positioned within the well bore, extending at one end thereof from the well head, either surface or subsea, and connected at or near the other end thereof to a tubing string or liner having a bore that is smaller than that through the casing string. As another example, the tubular may be comprised of a tubing string positioned within the well bore, extending at one end thereof from the well head, either surface or subsea, and connected at or near the other end thereof to a casing string or liner having a bore that is larger than that through the tubing string. Environments other than a subterranean well in which tubulars may be used in accordance with the present invention, include, but are not limited to, pipelines and sewer lines In this embodiment, the tools 10 are provided for the purpose of well fracturing. Each tool 10 has a main bore 12 which in use is coaxial with the tubular positioned within a well bore and a number of transverse fluid ports 14. The main bore 12 of the tool 10 defines a number of annular grooves or recesses 16, the recesses 16 each being equally and longitudinally spaced apart by a predetermined spacing. The number of recesses 16 can be configured to be the same as the total number of tools 10.

Figure 2:
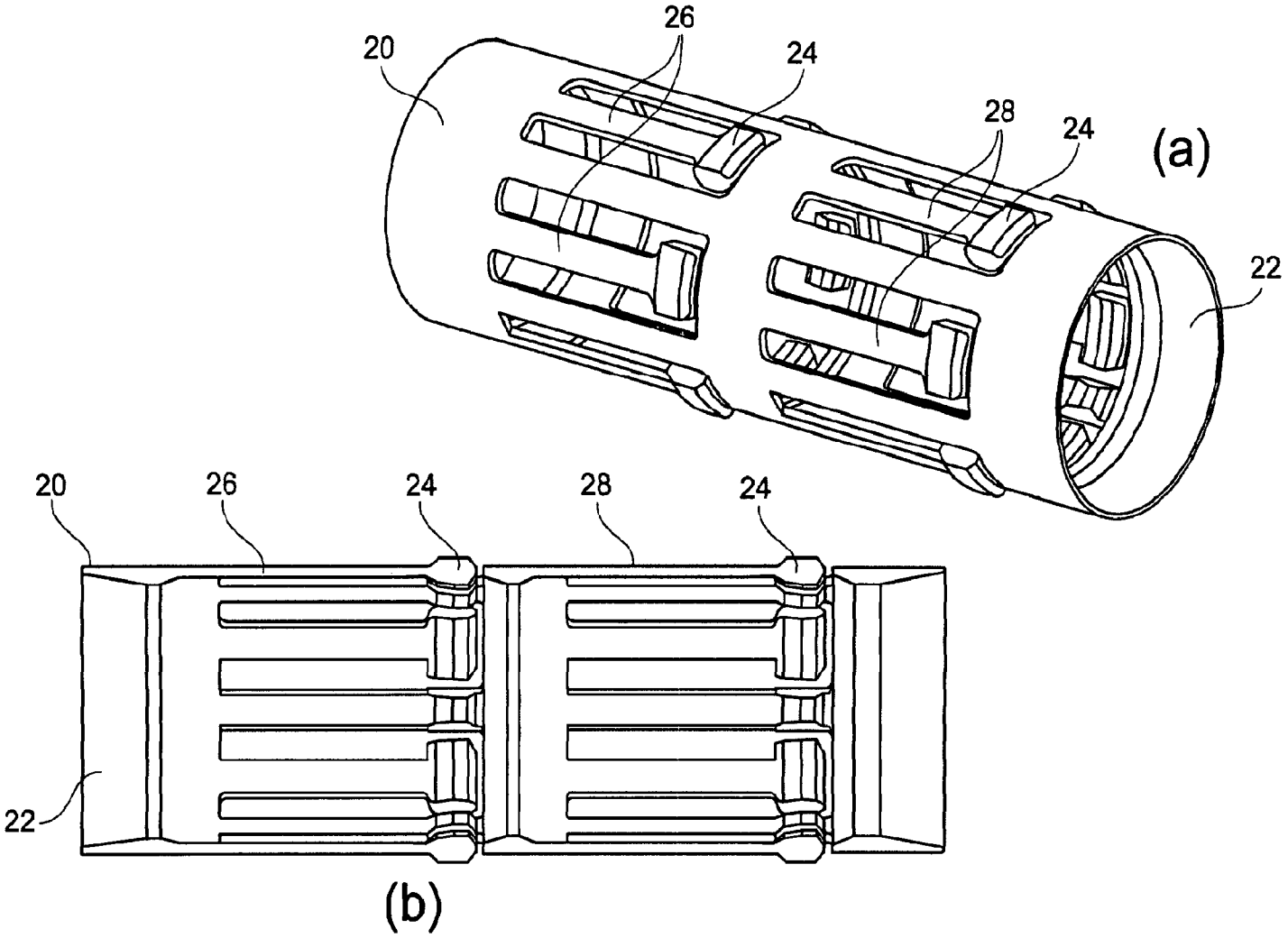
FIG. 2 is a (a) perspective view and a (b) sectional side view of a collet of a downhole actuating apparatus.

Inserted within the main bore 12 of each tool 10 is a collet 20 as shown in FIGS. 3 to 7. Referring to FIG. 2, the collet 20 is tubular and has a bore 22 which is coaxial with the main bore 12 when the collet 20 is inserted within the main bore 12. Each collet 20 has two sets of flexible fingers and a protrusion 24 is provided at the end of each finger. Each finger is bendable, when a transverse force is applied to the protrusion 24, between a first position in which the protrusion 24 is out with the bore 22 of the collet 20 and a second position in which the protrusion 24 is within the bore 22. When the collet 20 is inserted within the main bore 12, each protrusion 24 is at the first position when engaged with a recess 16 and at the second position when the protrusion 24 is not engaged with a recess 16.

The first set of fingers 26 and the second set of fingers 28 are longitudinally spaced apart by a predetermined distance. This distance is configured so that, when the fingers 26 of the first set are engaged with a recess 16, the fingers 28 of the second set are not engaged with a recess 16, rather they are between two adjacent recesses 16 and so at the second position.

The collet 20 is adapted such that a dropped object such as a ball 30 can pass through the main bore 12 but it will contact the protrusion 24 of any fingers which are at the second position. FIGS. 4 to 7 show a ball 30, dropped from the surface and travelling in direction 100, passing through the collet 20.

Figure 4:
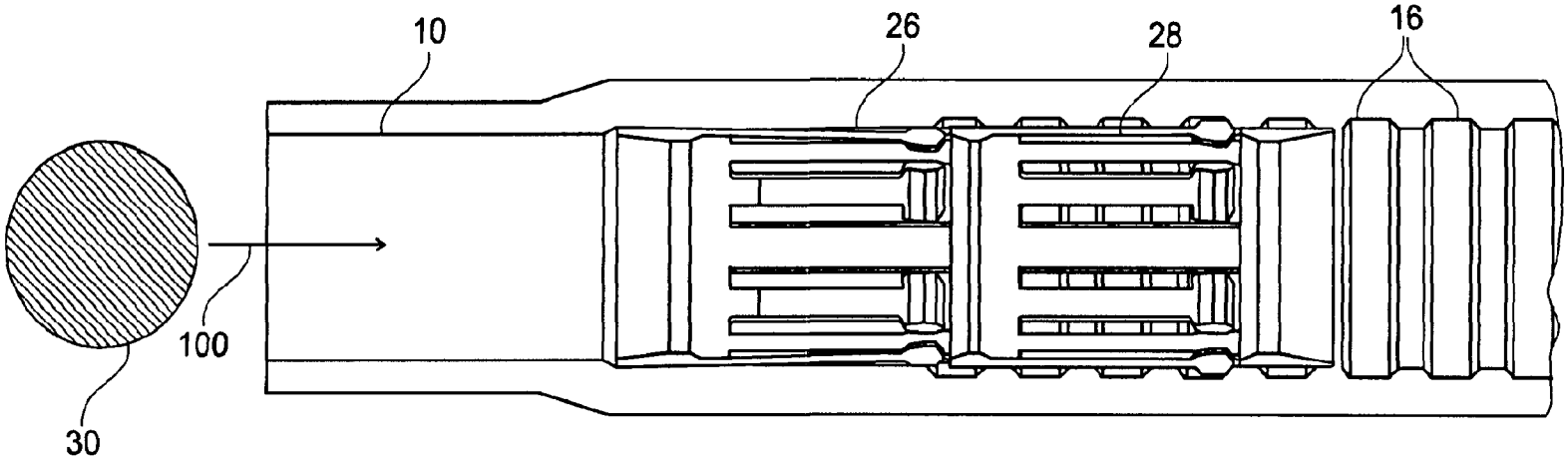
FIG. 4 is a detailed sectional side view of a portion of the tool of FIG. 1 with a ball approaching the tool.

As shown in FIG. 4, each protrusion 24 of the second set of fingers 28 is engaged with a recess 16 and so are unbent and at the first position. However, the protrusions 24 of the first set of fingers 26 are engaged with a recess 16 and so are bent inwards to the second position. It should be noted that the collet 20 could be configured such that the first set of fingers 26 are at the first position and the second set of fingers 28 are at the second position.

Figure 5:
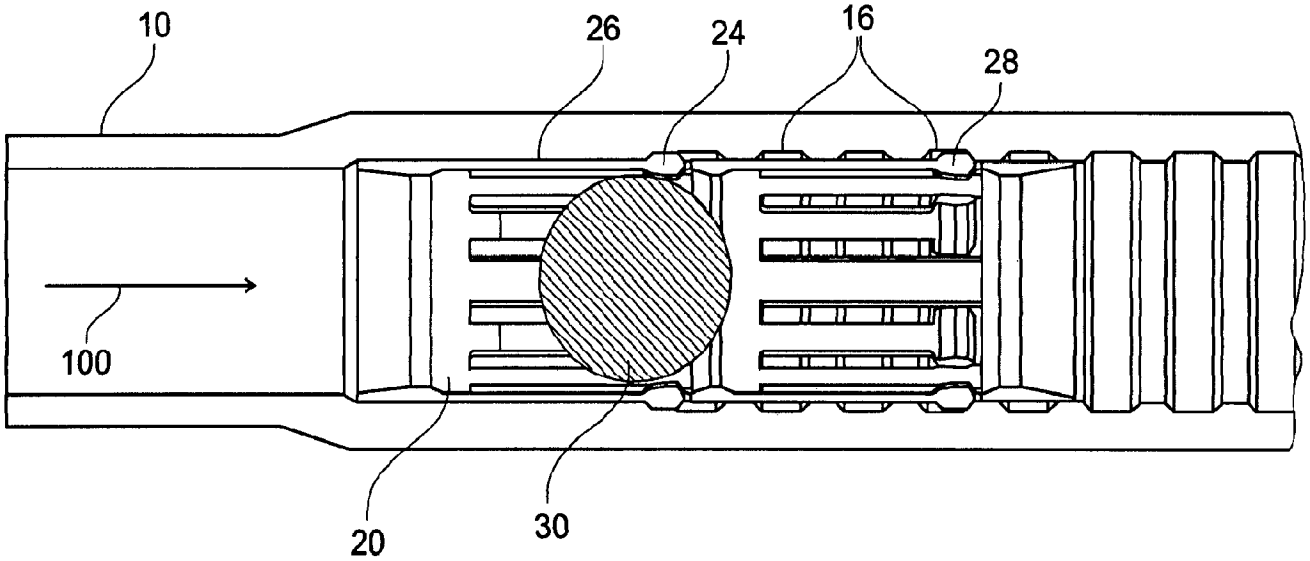
FIG. 5 is a detailed sectional side view of a portion of the tool of FIG. 1 with the ball landing at the first seat.

As shown in FIG. 5, the ball 30 contacts the protrusions 24 of the first set of fingers 26 since they are within the bore 22. One or both of the impact force from the ball 30 and fluid pressure upstream of the ball 30 then causes the collet 20 to be linearly moved in the travel direction 100. This causes the second set of fingers 28 to disengage from the recess 16 and linearly move to a location between this recess 16 and the next recess 16. These fingers 28 are now at the second position. At the same time, the first set of fingers 26 move forward to engage with the next recess 16 causing the fingers 26 to unbend to the first position. The protrusions 24 and recesses 16 are suitably profiled to allow the protrusion 24 to disengage from the recess 16 when a sufficient linear force is applied.

Figure 6:
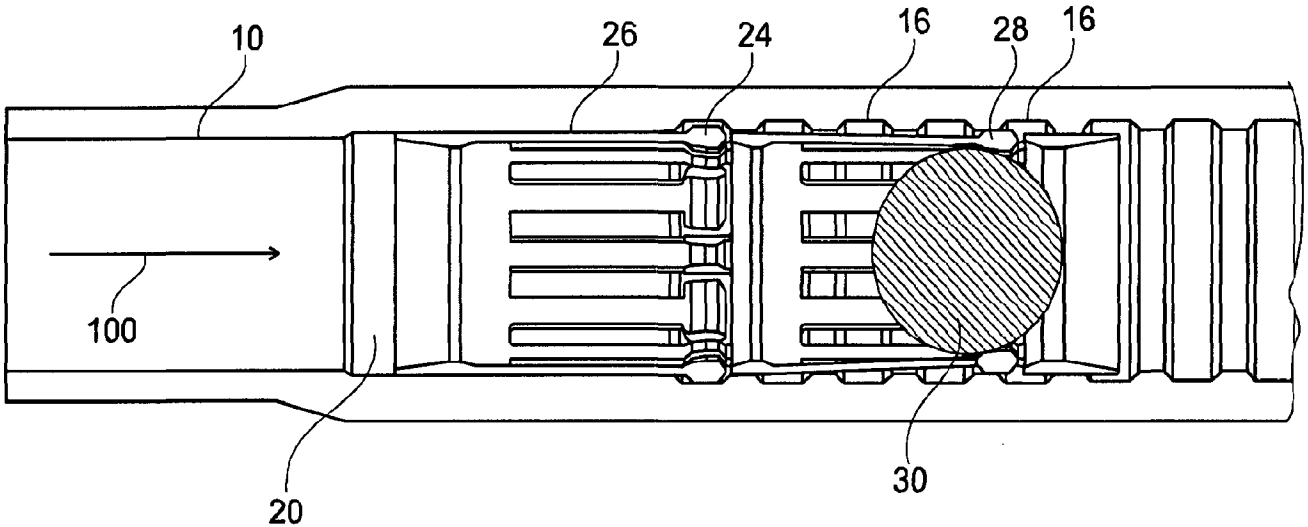
FIG. 6 is a detailed sectional side view of a portion of the tool of FIG. 1 with the ball landing at the second seat.

FIG. 6 shows the fingers in their new positions. Also, with the first set of fingers 26 at the first position, the ball 30 is free to continue its travel until it meets the second set of fingers 28. Since these are now at the second position, the ball 30 is stopped at this location.

Again, the impact force from the ball 30 and/or fluid pressure upstream of the ball 30 causes the collet 20 to be linearly moved in the travel direction 100. This causes the first set of fingers 26 to disengage from the recess 14 and linearly move to a location between this recess 14 and the next recess 14. These fingers 26 are now at the second position. At the same time, the second set of fingers 28 move forward to engage with the next recess 14 causing the fingers 28 to unbend to the first position.

Figure 7:
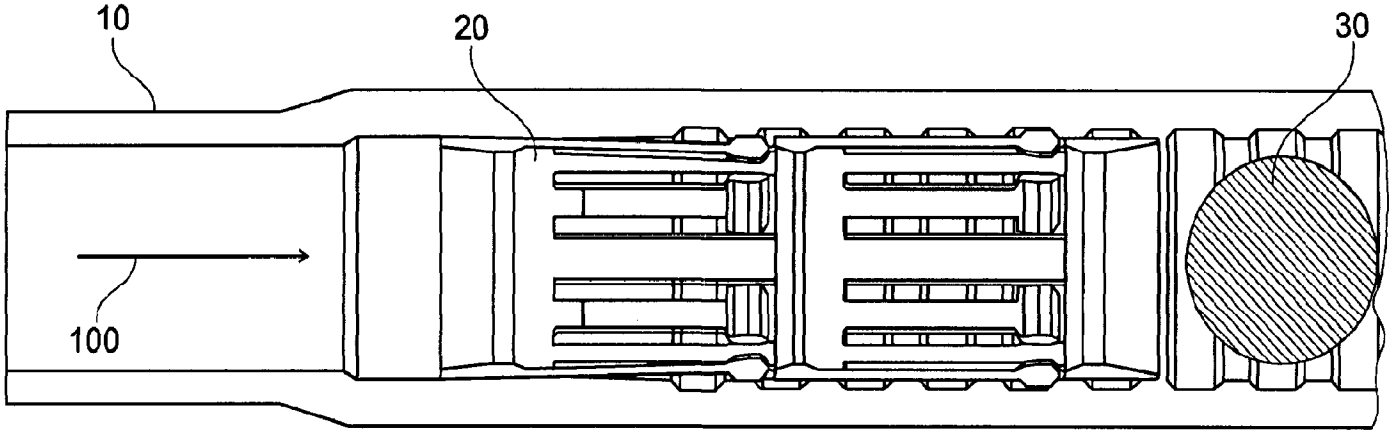
FIG. 7 is a detailed sectional side view of a portion of the tool of FIG. 1 with the ball released.

FIG. 7 shows the fingers in their new positions. It should be noted that these positions are the same as their original positions before the ball 30 approached the collet 20. With the second set of fingers 28 at the first position, the ball 30 is free to continue its travel along the well bore, exiting this tool 10. The ball 30 will continue to travel through a tubular to the next tool 10 where it will drive forward the collet 20 associated with the tool 10 and so on until the last tool is reached.

Therefore, the overall effect of the ball 30 passing through the tools 10 is that the associated collet 20 is linearly moved forward one recess 16. Any subsequently dropped balls 30 would have the same effect. The collet 20 is therefore linearly moved in a stepwise sequence, moving one recess 16 every time a ball 30 is dropped.

Figure 3:
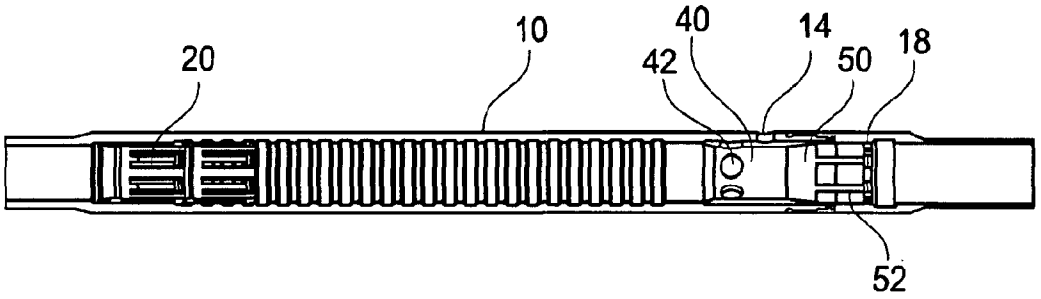
FIG. 3 is a sectional side view of a tool of a downhole actuating apparatus with a sleeve in the closed position.

Each tool 10 includes a sleeve 40, as shown in FIGS. 1 and 3. The sleeve 40 includes a number of apertures 42. In its normal position, the sleeve 40 is connected to the main bore 12 by a connecting member or shear pin and, at this position, the apertures 42 are longitudinally spaced from the transverse ports 14. Therefore, the sleeve 40 blocks the transverse ports 14 to fluid within the main bore 12. FIG. 2 shows this normal position with the transverse ports 14 blocked. Seals are provided to prevent leakage of fluid from the main bore 12 to the transverse ports 14.

As shown in FIG. 3, a second collet 50 is provided within the main bore 12 just downstream of the sleeve 40. With the sleeve 40 in its normal position, the protrusion of the fingers 52 of the second collet 50 are engaged with second recesses 18 provided at the main bore 12. Therefore, the second collet 50 is unaffected by any dropped balls 30 passing through the tool 10.

When a predetermined number of balls 30 have been dropped for the particular tool 10, the collet 20 will have been moved to reach and contact the sleeve 40 and this is termed the actuation site. Further linear movement of the collet 20 applies a longitudinal force on the sleeve 40 to linearly move the sleeve 40 when the force is great enough to cause shearing of the shear pin. This movement of the sleeve 40 causes alignment of the apertures 42 of the sleeve 40 and the transverse ports 14 so that there is fluid communication between the main bore 12 and the transverse ports 14. The movement also causes the sleeve 40 to act upon and linearly move the second collet 50 such that the protrusions of the fingers 52 of the second collet 50 disengage with second recesses 18. A dropped ball 30 will stop at these protrusions and block the main bore 12.

Therefore, the main bore 12 is now blocked and the transverse ports 14 are open. The tool 10 has been actuated and fluid travelling in the well bore in direction 100 will be diverted out of the tool 10 via the transverse ports 14.

The apparatus can be arranged so that the collet 20 is located within the main bore 12 of a particular tool 10 at a predetermined number of recesses 16 from the actuation site. The tools 10 can be arranged so that this predetermined number of recesses 16 varies for each tool 10 depending on its proximity to the surface. The tool 10 furthest from the surface can involve only one recess 16, while the tool 10 nearest the surface could have the greatest number of recesses 16, such as fifty. The tools 10 with a collet 20 which is a smaller number of recesses 16 from the sleeve 40 will actuate first. The tools 10 will therefore sequentially actuate in the order of furthest away to nearest.

Therefore, each tool 10 is provided with indexing means which is adapted to register receipt of an actuating signal (the dropped ball 30) and to cause actuation of the tool 10 when a predetermined number of actuating signals has been received. At least two of the tools 10 is actuated when a different predetermined number of actuating signals has been received and so the downhole tools 10 are sequentially actuatable.

Also, the predetermined number of recesses 14 for each tool 10 corresponds to the predetermined number of actuating signals. This may be an identically correspondence, or the predetermined number of recesses could equal, say, the predetermined number of actuating signals minus one. This would be the case if the collet 20 is moved, say, four recesses 14 to move the sleeve and a fifth ball 30 is used to block the main bore 12 (rather than the fourth ball 30 moving the sleeve before being caught by the second collet 50).

The present invention allows each tool 10 to have a valve seat of the same size and to have a main bore of the same size which is substantially equivalent to the bore through the tubular. Each ball 30 dropped is also the same size. It should also be noted that the mechanical counting device of the present invention is non-electrical, non-electronic and non-magnetic. Rather, it is a fully mechanical apparatus.

Figure 8:
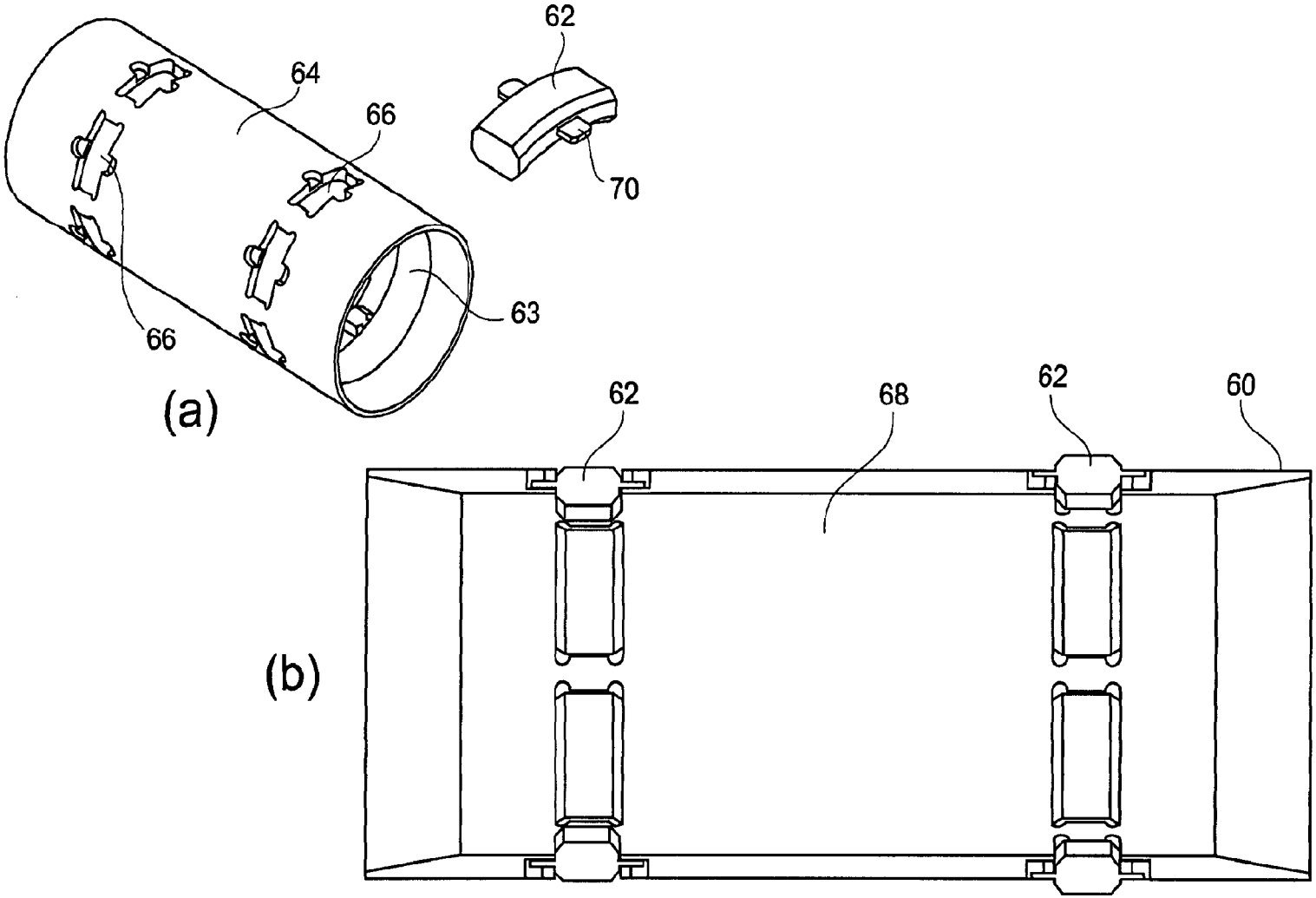
FIG. 8 is a (a) perspective view and a (b) sectional side view of a dog assembly.

FIG. 8 shows an alternative mechanical counting device which is a dog assembly 60 that may be used with the tool 10. In this embodiment, two sets of dogs 62 are provided, rather than the fingers of the collet 20. Each set of dogs 62 are equispaced around the tubular body 64 of the dog assembly 60. As before, the dogs 62 are engagable with recesses 16 of the tool 10.

Each dog 62 comprises a block of material, such as steel which is provided within an aperture 66 of the tubular body 84. Each dog 62 is thicker than the thickness of the tubular body 64 and is movable between a first position in which the under surface of the dog 62 is flush with the inner surface of the tubular body 64 (and so does not protrude into the bore 68 of the tubular body 64) and a second position in which the dog 62 protrudes into the bore 22. FIG. 8 (*b*) shows both positions. Each dog 62 includes two wings 70 to prevent the dog 62 from escaping the aperture 66 and falling into the bore 68.

A dropped ball 30 will contact the dogs 62 of the first set since they are within the bore 68. The dog assembly 60 will then be linearly moved in the travel direction 100 which causes the dogs 62 of the second set to disengage from the recess 16 and linearly move to the second position. At the same time, the dog 62 of the first set will move forward to the first position. The ball 30 is now free to continue forward until it meets the dog 62 of the second set since they are now at the second position.

The dog assembly 60 is then linearly moved as the ball 30 acts upon the dogs 62 of the second set. This causes the dogs 62 of the first set to disengage from the recess 16 and linearly move to the second position. At the same time, the dogs 62 of the second set move forward to engage with the next recess 16. The ball 30 is now free to continue its travel along the well bore, exiting this tool 10.

Whilst specific embodiments of the present invention have been described above, it will be appreciated that departures from the described embodiments may still fall within the scope of the present invention.

The invention claimed is:

1. A downhole tool, comprising:

a housing defining a main bore;

an actuatable member moveable from a first configuration to a second configuration;

an indexer mounted within and engaged with the housing and arranged to progress linearly in a first direction along the main bore of the housing in a predetermined number of discrete sequential and progressive steps of linear movement in said first direction by passage of a corresponding number of objects through the tool to cause said actuatable member to move towards its second configuration; and an object interface arrangement to be engaged by an object and to transfer a drive energy or force from the object to the indexer such that the object drives the indexer to move at least one discrete step.

2. The downhole tool of claim 1, wherein the indexer is mounted within the housing on one axial side of the actuatable member.

3. The downhole tool of claim 1, wherein the actuatable member is moveable in the first direction from its first configuration to its second configuration.

4. The downhole tool of claim 1, wherein the indexer is arranged to be retained relative to the housing following each discrete step of linear movement to facilitate progressive steps of linear movement.

5. The downhole tool of claim 1, wherein the indexer is arranged to progress linearly along the main bore of the housing to contact the actuatable member and cause said actuatable member to move towards its second configuration.

6. The downhole tool of claim 1, wherein the indexer is arranged such that a final discrete step of linear movement of the indexer causes the actuatable member to move towards its second configuration.

7. The downhole tool of claim 1, wherein the housing defines a flow port which is blocked when the actuatable member is arranged in its first configuration and is opened when the actuatable member is arranged in its second configuration.

8. The downhole tool of claim 1, wherein a discrete step of linear movement is caused by passage of an object travelling in the first direction.

9. The downhole tool of claim 1, wherein the housing defines an indexing profile for cooperating with the indexer to facilitate discrete sequential and progressive steps of linear movement of the indexer upon passage of corresponding objects.

10. The downhole tool of claim 9, wherein the indexing profile comprises a plurality of recesses arranged along the main bore of the housing.

11. The downhole tool of claim 10, wherein each discrete step of linear movement corresponds to the indexer moving from one recess to another recess of the indexing profile.

12. The downhole tool of claim 9, wherein the indexer cooperates with the indexing profile to retain the indexer relative to the housing following each discrete step of linear movement to facilitate progressive steps of linear movement.

13. The downhole tool of claim 1, comprising a seat to catch an object travelling through the tool in the first direction.

14. The downhole tool of claim 13, wherein the seat is located within the tool to catch an object which has at least partially passed through the indexer in the first direction.

15. The downhole tool of claim 13, wherein the seat is located within the tool to catch an object which has at least partially passed through the actuatable member in the first direction.

16. The downhole tool of claim 13, wherein the seat is reconfigurable between a release configuration to a catching configuration to selectively catch an object travelling through the tool in the first direction.

17. The downhole tool according to claim 16, wherein the seat is reconfigurable from its release configuration to its catching configuration by movement of the actuatable member from its first configuration to its second configuration.

18. The downhole tool according to claim 17, wherein the collet member is arranged to be acted upon by the actuatable member during movement of said actuatable member from its first to its second configuration to facilitate reconfiguration of the seat from a release configuration to a catching configuration.

19. The downhole tool according to claim 13, wherein the seat is provided on a collet member.

20. The downhole tool of claim 13, wherein the housing defines a flow port which is blocked when the actuatable member is arranged in its first configuration and is opened when the actuatable member is arranged in its second configuration, wherein the seat is arranged to catch an object to divert fluid from the main bore through the flow port once opened.

21. The downhole tool of claim 1, wherein each discrete step of linear movement is caused by impact of a passing object against the object interface arrangement.

22. The downhole tool of claim 1, wherein each discrete step of linear movement is caused by a pressure differential acting across a passing object when said object is engaged with the object interface arrangement.

23. A method for downhole actuation, comprising:

arranging an actuatable member in a first configuration within a bore of a housing; arranging an indexer within and in engagement with the housing;

passing a plurality of objects through the indexer to move said indexer linearly along the main bore of the housing in a number of discrete sequential and progressive steps of linear movement until the indexer causes the actuatable member to move towards a second configuration, wherein each passing object engages an object interface arrangement which transfers a drive energy or force from the object to the linear indexer such that the object drives the linear indexer to move at least one discrete step of linear movement.

24. The method of claim 23, wherein the indexer is initially mounted within the housing to be axially spaced from the actuatable member.

25. The method of claim 24, wherein the indexer is moved in a number of discrete sequential and progressive steps upon passage of a corresponding number of objects to progress said indexer towards the actuatable member to contact the actuatable member and cause said actuatable member to move towards its second configuration.

26. A downhole tool, comprising:

a housing defining a main bore;

an actuatable member moveable from a first configuration to a second configuration to permit actuation of the tool;

an indexer mounted within the housing on one axial side of the actuatable member and arranged to progress linearly along the main bore of the housing towards the actuatable member in a predetermined number of discrete steps of linear movement by passage of a corresponding number of the objects through the indexer to contact the actuatable member and cause said actuatable member to move towards its second configuration; and an object interface arrangement to be engaged by an object and to transfer a drive energy or force from the object to the indexer such that the object drives the indexer to move at least one discrete step.

27. A method for fracturing a well, comprising:

arranging a fracturing tool within a wellbore;

delivering a number of objects through an indexer mounted within a main bore of the tool to linearly progress the indexer along said main bore in a corresponding number of discrete steps of linear movement to actuate a member located on one axial side of the indexer to cause said member to move and cause opening of a fluid port;

blocking the main bore at a location on a side of the member opposite to that of the indexer; and flowing a fracturing fluid through the opened fluid port.

28. A downhole tool, comprising:

an actuatable member;

a first collet member adapted to register the presence of an object transported therethrough to cause movement of the actuatable member to actuate the tool when a predetermined number of objects has been registered; and a second collet member provided downstream of the actuatable member, wherein movement of the actuatable member causes the second collet member to disengage a recess such that an object is stopped by the second collet member.

* * * * *